United States Patent [19]

Brugman

[11] Patent Number: 4,658,562

[45] Date of Patent: Apr. 21, 1987

[54] GRID PANELS SUSPENDED BY SLIDABLE BRACKETS

[75] Inventor: Johannes A. Brugman, Rotterdam, Netherlands

[73] Assignee: Hunter Douglas International N.V., Curacao, Netherlands Antilles

[21] Appl. No.: 805,639

[22] Filed: Dec. 6, 1985

[30] Foreign Application Priority Data

Apr. 11, 1985 [GB] United Kingdom ..... 8509345

[51] Int. Cl.[4] ..... E04B 5/52

[52] U.S. Cl. ..... 52/665

[58] Field of Search ..... 52/660–669, 52/488, 484, 489, 98, 106; 404/35, 36

[56] References Cited

U.S. PATENT DOCUMENTS

| | | | |
|---|---|---|---|
| 940,912 | 11/1909 | Youngblood | 52/106 |
| 3,369,332 | 2/1968 | Harlan | 52/98 |
| 4,479,341 | 10/1984 | Schuplin | 52/489 |
| 4,492,066 | 1/1985 | LaLonde | 52/489 |

FOREIGN PATENT DOCUMENTS

| | | |
|---|---|---|
| 0115415 | 8/1984 | European Pat. Off. . |
| 1403026 | 8/1975 | United Kingdom . |
| 2122666 | 1/1984 | United Kingdom . |

*Primary Examiner*—James L. Ridgill, Jr.
*Attorney, Agent, or Firm*—Pennie & Edmonds

[57] ABSTRACT

A grid ceiling comprising a supporting grid (10,20) with rectangular openings therein, grid panels (30) mounted within said openings. The grid panels may be in the form of grid units including perpendicular hollow interior primary and secondary panels (40,50). The grid panels (30) are secured in place by longitudinally movable clips (60) which engage the carriers, e.g. in apertures or recesses (24). Each clip is slidable longitudinally from a forward position in which can occur and a retracted position in which the tongue is sufficiently within its associated panel to enable the grid panel to be removed.

8 Claims, 5 Drawing Figures

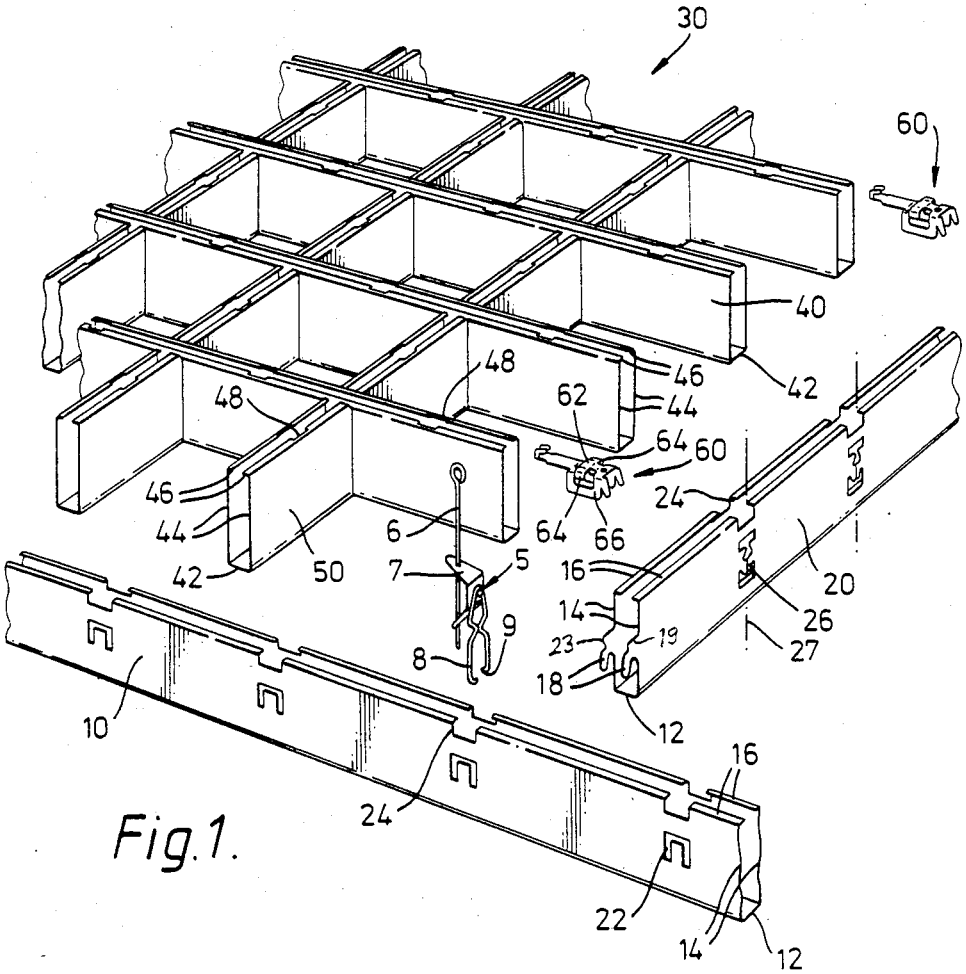
Fig. 1.
Fig. 2.
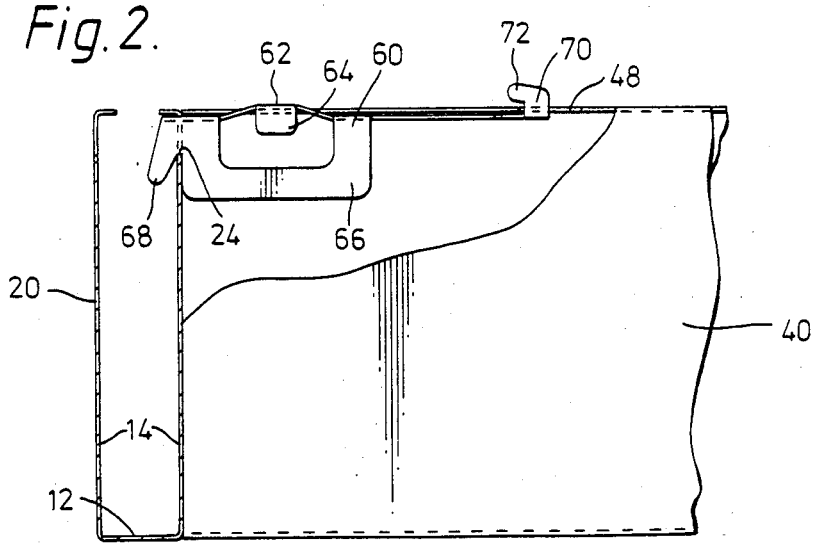

GRID PANELS SUSPENDED BY SLIDABLE BRACKETS

DESCRIPTION

The present invention relates to a grid ceiling.

Various forms of grid ceiling have been proposed and one example is in GB - A-No. 2122666 in which the ceiling includes sets of first and of second parallel elongate carriers, the first and second carriers being arranged transverse to one another to form a supporting grid with rectangular openings therein, with the ends of the second carriers abutting the sides of the first carriers. Grid units are mounted within the openings, the grid units being formed of primary and secondary panels having a hollow interior, the primary panels extending perpendicular to the secondary panels.

The carriers are of a particular structure which is intended to hold a light fitting and is provided with downwardly extending flanges having grooves therein, the grooves serving to accommodate the ends of spring-loaded latching members, which pass through the grid units and can be manually pulled to release the grid units thereby enabling them to be removed from the openings in the supporting grid. Such a structure is expensive and requires a difficult handling of the grid units to align and engage the latches in the grooves in the special additional downturned flanges. It is also quite difficult easily to demount the grid units in practice.

It has been proposed in EP-A-No. 115415 to use, in place of the spring-loaded latching members, some rather complex clips which in order to be engaged to secure the grid units to the supporting grid, need to be inserted from above which is extremely cumbersome and difficult to put into effect. In fact the grid units have inturned flanges at the ends to be engaged by these clips and this gives rise to difficulty of adapting a ceiling structure to a particular dimension and shape of a room or space to be provided with the grid ceiling. Since the first and second carriers together form sections in the region of 60×60 centimeters or 60×120 centimeters, corresponding to the grid unit dimensions, it will be clear that the edge portions of such ceilings frequently must be adapted to fit into a particular ceiling area. A consequence of this is that adapted or incomplete frame sections, e.g. multi-angled units and/or sections having a smaller dimension than 60 centimeters, will require equal adaptation of the grid units. Cutting down of the grid units for this purpose results in the loss of the inturned flanges used for mounting the grid units in the supporting grid.

It is now proposed, according to the present invention to provide a grid ceiling comprising sets of first and of second parallel elongate carriers, the first and second carriers being arranged transverse to one another to form a supporting grid with rectangular openings therein, grid panels mounted within said openings, said grid panels having a hollow interior, a plurality of securing clips, each clip being slidable at least in part within the hollow interior of a grid panel, adjacent the end thereof, each clip being formed with at least one tongue thereon, each clip being manually slidable longitudinally of the panel in which it is located, to an advanced position with the tongue then extending beyond the end of the associated panel, so as to engage a carrier, in part forming the relevant grid opening, the number of clips and their position on each grid panel being such as to enable the grid panel then to be held in place in its opening, the clips being slidable by acting manually on a portion thereof, to a retracted position in which said at least one tongue cannot engage the carrier, thereby to enable the grid panel to be removed.

The grid panels mounted within an opening may be simply arranged parallel to one another, in the manner of the rungs of a ladder, or may form part of a grid unit mounted within said opening, and including primary and secondary panels, the primary panels extending perpendicular to the secondary panels.

With such a structure, the individual panels or panels of the grid units can have plain ends, that is with no inturned flanges, and there is no need to provide a special flange structure on the supporting grid. Where a grid unit is provided, the clips can be mounted on at least three of the panel ends of the grid unit and can readily be manually slid so that the tongues engage the carriers. If desired, one can readily cut off the ends of the individual panels of of the panels of the grid unit to suit a particular size of ceiling required for a particular room or other space.

While reference has been made to each clip having a tongue it is contemplated that it could have two or even more tongues with a tongue or tongues at one or both ends of the clip.

With the construction of the present invention the individual panel or grid unit can easily and readily be attached to the supporting grid and a light hand pressure from below the ceiling will immediately identify the individual panels or grid units from the supporting grid. Demounting the panel or grid unit will not disturb the remainder of the ceiling, in particular the supporting grid. The attachment point between the panel or grid unit and the supporting grid can be easily recognizable, but not obtrusive. The panels or grid units can remain readily mountable on the supporting frame after being adapted in shape and/or size, such adapted panels or grid units will remain readily demountable later.

The at least one tongue of each clip advantageously extends downwardly and is spaced forwardly from the front of the clip so as to enable it to be lowered into engagement with carrier when the clip is advanced. This means that the units need to be lifted somewhat in order to be engaged or disengaged from the carrier, which gives extra rigidity to the connection. While the tongues may engage, for example, an edge of a side flange of the carriers, they engage in apertures or recess in the sides of the carriers.

Advantageously the clips and associated panels have abutments limiting the movement of the clips and defining the advanced and retracted positions thereof and this may be effected by providing the panels of a channel cross-section the cross-section including a lower web joining two spaced side flanges, the upper edges of the side flanges including inturned rims and wherein the clips each have a portion overlying and slidable over said inturned rims.

In a preferred construction the rims have notches therein, and each clip has an upstanding stop member passing through said notch and engageable with the ends of the notch to define said advanced and retracted positions.

In this arrangement the stop member preferably extends over the rims when in the advanced position of the clip more securely to retain the clip in place.

The first and second carriers may also be of channel cross-section, and if desired of the same channel cross-section as the grid panels and in any event include a lower web joining two spaced side flanges, integral hooks being formed at the ends of said second carriers, whereby said hooks can be engaged in cooperating apertures in said first carriers to form said supporting grid, and cause the side flanges of said first carriers above the apertures to deform slightly as they are inserted and then spring back over the upper surface of the hooks to retain the hooks in place.

In order that the invention may more readily be understood, the following description is given, merely by way of example, reference being made to the accompanying drawings, in which:

FIG. 1 is an exploded perspective view of a portion of one embodiment of grid ceiling according to the invention;

FIG. 2 is an enlarged fragmentary section showing the connection between a grid unit and carrier, the clip in the advanced position;

Figure 3:
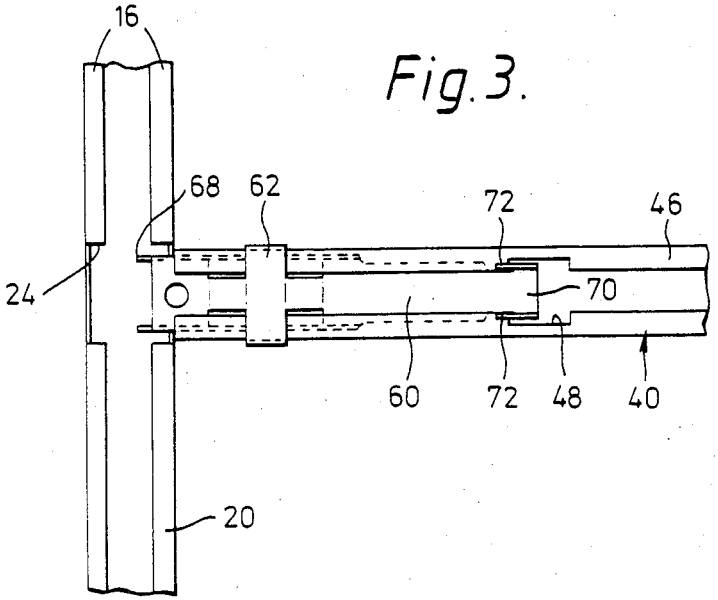
FIG. 3 is a top plan view of the portion shown in FIG. 2.

Referring first to FIG. 1, a grid ceiling is shown as including a first set of parallel carriers 10 and a second set of parallel carriers 20 at right angles thereto, the drawing only showing one of each of these carriers. Each of the carriers includes a channel cross-section hollow member having a web portion 12 and two spaced side flange portions 14, the upper free ends of which are provided with inturned rims 16. At the ends of the second carrier members are formed downwardly turned hooks 18, having an upper surface 19, which are engageable in inverted U-shaped apertures 22 in the carriers 10. The upper surfaces have a rounded projection 23 extending forwardly. When the hooks 18 are engaged in the apertures 22, the projections slightly deform a side flange portion of the carriers 10 and when the hooks have been forced down the side flange-portion of the carriers 10 above the apertures 22 springs back over the upper surface 19 to hold the hook in place. Each of the carriers 10, 20 are provided with notches 24, the notches 24 of the carrier 10 being immediately above the apertures 22. Immediately below the notches 24 of the carier 20 are further apertures 26, which are so shaped that when the carrier 20 is cut along one of the lines 27, there will be produced the hooks 18, when further portions have also been cut away.

Mounted in each opening defined by the carriers 10,20 are fitted grid panels in the form of grid units 30. These consist of primary grid unit panels 40 and secondary grid unit panels 50. These panels are suitably notched so that they can be interfitted with one another to form several cells of the square cross-section.

The panels 40,50 are of similar construction to the carriers 10,20 and include lower webs 42, side flanges 44 and inturned rims, the rims being provided with notches 48.

Engageable in the interior of the panels 40,50, are clips 60 of bent sheet metal, these including an upper saddle portion 62 having downturned end sections 64, the saddle portions 62 overlying the rims 46 and extending downwardly adjacent the side flanges 44. The saddle portion 62 is connected to a body part 66 which is a sliding fit within the interior of the side flanges 44 and has, at its forward end, downwardly angled tongues 68. At the rear end of each clip is a stop member 70 which has a forwardly extending portion 72.

Figure 4:
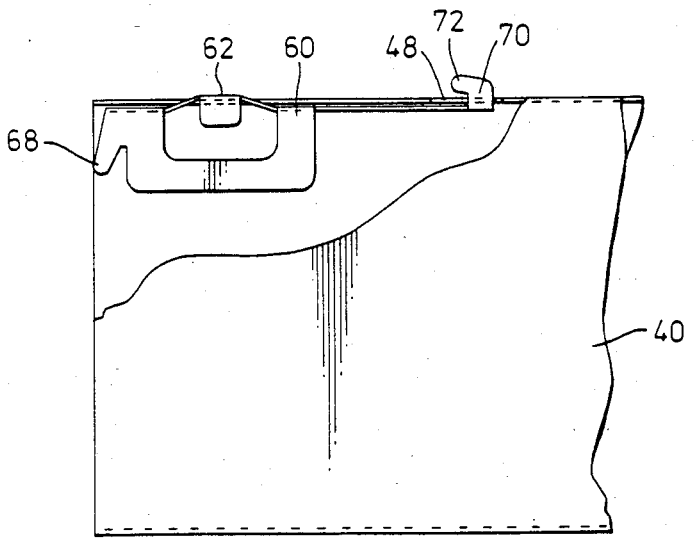
FIG. 4 is a view similar to FIG. 2, with the clip in the retracted position.

FIG. 2 shows the clip 60 advanced with the tongue 68 engaged in notch 24. In this position the stop 70 engages the left end (in FIG. 2) of the notch 48 with the portion 62 overlying the flanges 46. FIG. 4 shows the clip retracted with the tongue 68 wholly within the panel 40 and the stop 70 engaged against the right end of the notch 48. In fact while it is preferred to retract the tongue 68, so that it is within the panel, it need only be retracted sufficiently to disengage from notch 24.

In FIG. 1 only the panels 40 have been shown provided with the clips 60, but alternatively or in addition to the panels 50 could be provided with such clips to give greater rigidity. It is of course necessary to have at least three clips, which are located on the grid unit at spaced positions to give adequate support of the grid unit.

It will be appreciated that the clips can readily be located and retracted with the finger to remove the grid unit 30.

In order to mount the supporting grid formed by the carriers 10,20, hangers 5 themselves supported on a pin 6 by a bracket 7 and include arms 8 resiliently urged towards one another and having inwardly extending lugs 9. In order to mount the carrier, one forces them upwardly to cause these arms to spring out and they then spring back in again so that the lugs 9 engage in the upper limb of the inverted U-shaped apertures 22 and in this way the whole assembly can be hung from the ceiling.

It will be appreciated that the structure of the present invention is very easy to mount and is of simple and inexpensive construction, and furthermore enables one to cut off suitable portions of the length of the panels to suit dimensions of a particular room or other space.

I claim:

1. A grid ceiling comprising:

(a) a first set of parallel elongated carriers and a second set of parallel elongated carriers transverse thereto and interengaged therewith to form a supporting grid defining rectangular openings;

(b) grid panels mounted within said openings, said grid panels having a lower web, a pair of spaced side flanges extending upward from said web, upper edges of the side flanges including inturned edges, said web, side flanges and inturned edges defining a hollow interior of said grid panel;

(c) at least one securing clip having a body portion and a tongue, the body portion having a first part disposed within said hollow interior and a second part overlying and slidable on said inturned rims to cooperate with said first part and slidably hold said clip to said grid panel, said securing clip being slidable between an advanced position in which said tongue extends from an end of said grid panel to engage one of said first and second carriers and a retracted position in which said tongue does not engage a carrier.

2. A grid ceiling according to claim 1, wherein said grid panel forms part of a grid unit, mounted within said opening, and including primary and secondary panels, the primary panels extending perpendicular to the secondary panels.

3. A grid ceiling according to claim 2, wherein said at least one tongue of each clip is angled downwardly so as to be lowered relative to the associated carrier, when the clip is advanced.

4. A grid ceiling according claim l, wherein said first and second carriers are of channel cross-section, including a lower web portion joining two spaced side flanges, integral hooks being formed at the ends of said second carriers, whereby said hooks can be engaged in cooperating apertures in the sides of said first carriers to form said supporting grid and cause the side flange portions of said first carrier above the apertures to deform slightly as they are inserted and then spring back over the upper surfaces of the hooks to retain the hooks in place.

5. A grid ceiling according to claim 4, wherein said carriers include further apertures or recesses in which the tongues of the clips engage.

6. A grid ceiling according to claim 1 wherein the clips and associated panels have abutments limiting the movement of the clips and defining the advanced and retracted positions thereof.

7. A grid ceiling according to claim 6 wherein said rims have notches therein, and each clip has an upstanding stop member passing through said notch and engageable with the ends of the notch to define said advanced and retracted positions.

8. A grid ceiling according to claim 7 wherein said stop member extends over said rims, when in the advanced position of the clip.

* * * * *

UNITED STATES PATENT AND TRADEMARK OFFICE

CERTIFICATE OF CORRECTION

PATENT NO. : 4,658,562

DATED : April 21, 1987

INVENTOR(S) : Johannes A. Brugman

Figure 5:
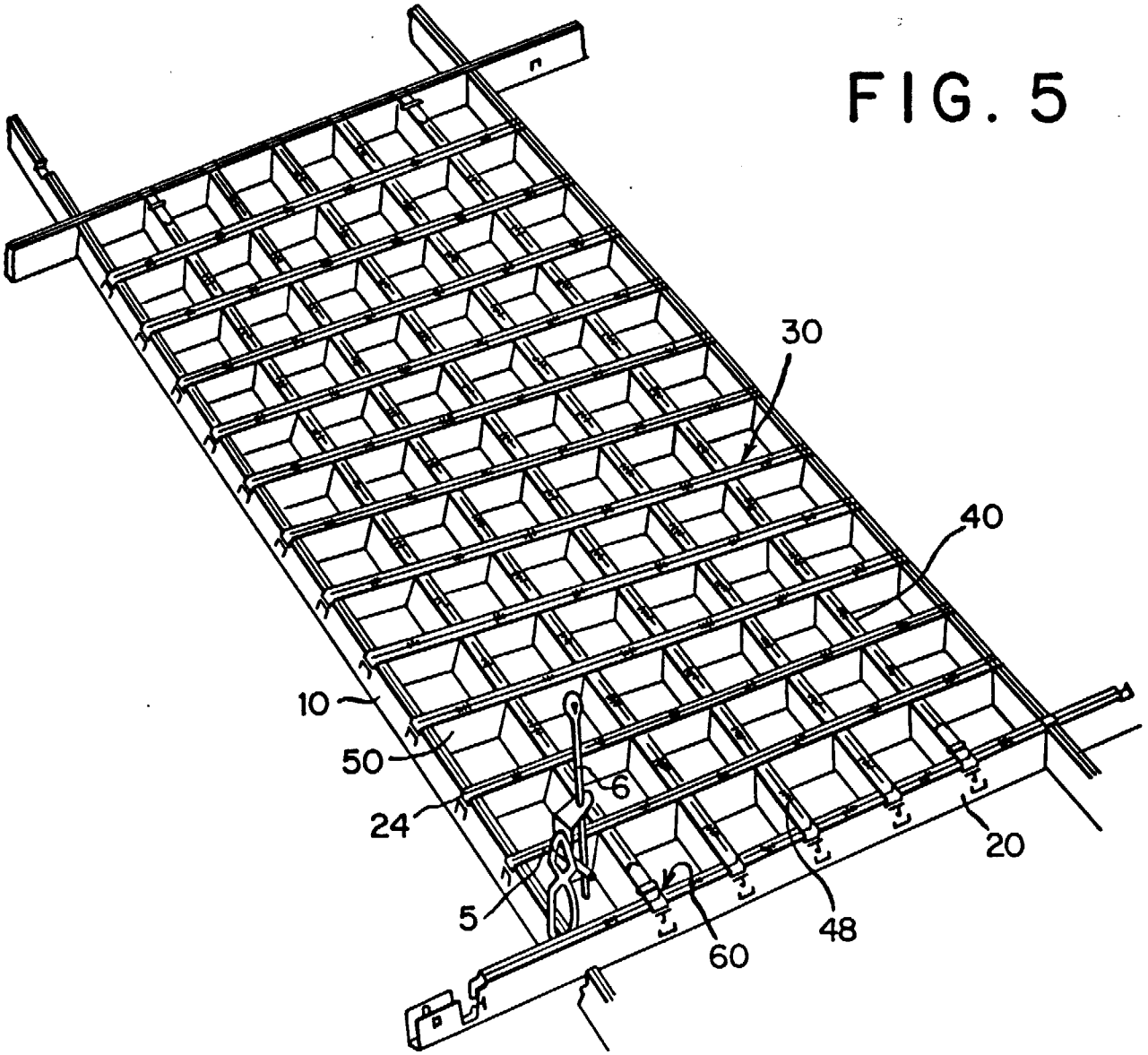
FIG. 5 is a perspective view of grid panels mounted within the rectangular openings.

It is certified that error appears in the above-identified patent and that said Letters Patent is hereby corrected as shown below:

In the drawings:

Sheet 2, after Fig. 4 and before the title of the invention, the attached representation of Fig. 5 should appear:

Signed and Sealed this

Sixteenth Day of February, 1988

*Attest:*

DONALD J. QUIGG

*Attesting Officer*

*Commissioner of Patents and Trademarks*

Patent No. 4,658,562

April 21, 1987

Johannes A. Brugman